US011620921B2

(12) United States Patent
Mezrahi

(10) Patent No.: US 11,620,921 B2
(45) Date of Patent: Apr. 4, 2023

(54) REUSABLE PORTABLE FOLDABLE SIGN ASSEMBLY

(71) Applicant: XpressBoards, LLC, Merrick, NY (US)

(72) Inventor: Priscilla Mezrahi, Merrick, NY (US)

(73) Assignee: XpressBoards, LLC, Merrick, NY (US)

( * ) Notice: Subject to any disclaimer, the term of this patent is extended or adjusted under 35 U.S.C. 154(b) by 0 days.

(21) Appl. No.: 17/846,706

(22) Filed: Jun. 22, 2022

(65) Prior Publication Data

US 2022/0415214 A1 Dec. 29, 2022

Related U.S. Application Data

(60) Provisional application No. 63/214,018, filed on Jun. 23, 2021.

(51) Int. Cl.

| | |
|---|---|
| ***G09F 7/18*** | (2006.01) |
| ***G09F 7/22*** | (2006.01) |
| *G09F 15/00* | (2006.01) |

(52) U.S. Cl.

CPC ..... *G09F 7/22* (2013.01); *G09F 15/0037* (2013.01); *G09F 15/0056* (2013.01); *G09F 15/0062* (2013.01); *G09F 2007/1804* (2013.01)

(58) Field of Classification Search

CPC ... A47B 23/043; A47B 23/044; A47B 23/046; A47B 97/08; A47B 2220/0019; A47F 5/11; A47F 5/112; A47F 5/118; G09F 1/06; G09F 1/10; G09F 5/04; G09F 7/18; G09F 2007/1847; G09F 15/00; G09F 15/0037; G09F 15/0056; G09F 15/0062; F16M 11/28; F16M 13/005; B42D 15/042; B42D 1/08; B42F 5/00

USPC ..... 248/511, 514, 516, 519, 520; 434/408, 434/413, 414

See application file for complete search history.

(56) References Cited

U.S. PATENT DOCUMENTS

| | | | |
|---|---|---|---|
| 3,009,235 | A | 11/1961 | Mestral |
| 5,163,845 | A | 11/1992 | Blassingame |
| 5,388,861 | A | 2/1995 | Reiter |

(Continued)

FOREIGN PATENT DOCUMENTS

| | | |
|---|---|---|
| CN | 107825900 | 3/2018 |
| DE | 202006006556 | 6/2006 |

(Continued)

*Primary Examiner* — Cassandra Davis

(74) *Attorney, Agent, or Firm* — Stradley Ronon Stevens & Young, LLC

(57) ABSTRACT

A reusable, portable, foldable sign assembly. The assembly has a sign board including first and second sign board portions configured to form an open position in which the sign board portions are aligned linearly and a closed position in which the sign board portions are folded against each other, and at least one handhold to facilitate manipulation by a user. A connecting mechanism holds the first sign board portion and the second sign board portion together. A telescoping extension pole is removably and pivotably attached to the sign board, operable to support the weight of the assembly, and configured to assume an infinite number of extended lengths as desired and set by the user. A transparent cover sleeve is removably attached on one or both of the first sign board portion and the second sign board portion.

20 Claims, 6 Drawing Sheets

(56) References Cited

U.S. PATENT DOCUMENTS

| | | | | |
|---|---|---|---|---|
| 5,409,383 | A | 4/1995 | Mannino | |
| 5,713,553 | A * | 2/1998 | Cooper | A47B 19/002 248/188.7 |
| 6,107,558 | A * | 8/2000 | Cowan | B42D 9/04 84/486 |
| 6,293,511 | B1 * | 9/2001 | Shepherd | A47B 19/002 248/441.1 |
| 6,682,352 | B2 | 1/2004 | Lopez | |
| 6,893,266 | B2 | 5/2005 | Donelan | |
| D509,247 | S | 9/2005 | Nash | |
| D520,562 | S | 5/2006 | Nash | |
| D532,822 | S | 11/2006 | White et al. | |
| 7,255,566 | B2 | 8/2007 | Galbraith | |
| 7,354,273 | B2 | 4/2008 | Donelan | |
| 7,980,857 | B2 | 7/2011 | Cheris | |
| 8,517,329 | B2 | 8/2013 | Nash et al. | |
| 8,641,426 | B2 | 2/2014 | Yang | |
| 8,672,687 | B2 | 3/2014 | Shanbour et al. | |
| 9,039,422 | B2 | 5/2015 | Shanbour, II et al. | |
| 9,090,116 | B2 | 7/2015 | Tunis et al. | |
| 9,381,768 | B2 | 7/2016 | Rhodes | |
| 9,481,199 | B2 | 11/2016 | Shanbour, II et al. | |
| 9,809,050 | B1 | 11/2017 | Hiatt | |
| 11,065,908 | B2 * | 7/2021 | Schorr, III | G09F 19/00 |
| 2002/0009703 | A1 | 1/2002 | Owen | |
| 2003/0051381 | A1 | 3/2003 | Hernandez et al. | |
| 2003/0079389 | A1 | 5/2003 | Eberly | |
| 2005/0066560 | A1 | 3/2005 | Ternovits et al. | |
| 2005/0186439 | A1 | 8/2005 | Staadecker et al. | |
| 2006/0237621 | A1 | 10/2006 | Wolff et al. | |
| 2008/0248456 | A1 | 10/2008 | Cheris et al. | |
| 2009/0068632 | A1 | 3/2009 | Thompson et al. | |
| 2009/0119958 | A1 * | 5/2009 | Thurston | G09F 1/10 40/124.2 |
| 2010/0267001 | A1 | 10/2010 | Sugai | |
| 2010/0310816 | A1 | 12/2010 | Aldrete-Frances | |
| 2011/0151427 | A1 | 6/2011 | Lin | |
| 2013/0224723 | A1 | 8/2013 | Gonzales et al. | |
| 2013/0273518 | A1 | 10/2013 | Papke | |
| 2013/0323707 | A1 | 12/2013 | Lyons et al. | |
| 2014/0014539 | A1 | 1/2014 | Jatwes | |
| 2014/0377736 | A1 | 12/2014 | Essen et al. | |
| 2015/0024369 | A1 | 1/2015 | Brown | |
| 2016/0101641 | A1 | 4/2016 | Gonzales, III | |
| 2016/0355049 | A1 | 12/2016 | Thomas | |
| 2017/0043612 | A1 | 2/2017 | Shanbour, II et al. | |
| 2017/0066281 | A1 | 3/2017 | Logan et al. | |
| 2018/0119372 | A1 | 5/2018 | McO'Neil et al. | |

FOREIGN PATENT DOCUMENTS

| | | | |
|---|---|---|---|
| KR | 20180002339 | | 1/2018 |
| KR | 20220023807 | * | 3/2022 |

* cited by examiner

REUSABLE PORTABLE FOLDABLE SIGN ASSEMBLY

RELATED APPLICATION

This application claims the benefit of priority to U.S. Provisional Patent Application Ser. No. 63/214,018, filed on Jun. 23, 2021, the contents of which are incorporated in this application by reference.

TECHNICAL FIELD

The present disclosure relates generally to signs used to display and communicate messages and information and, more particularly, to a reusable, portable, and foldable sign that provides the multiple advantages required by a modern presenter to an audience.

BACKGROUND OF THE INVENTION

Portable signs are ubiquitous in our society today. Variations include yard signs, roadside signs, marquee signs, advertising signs, political signs, sidewalk signs, and other visual aids. Such portable signs provide an excellent, low-cost way to achieve many functions, including advertising a business, displaying information, and communicating messages. Among the benefits of such portable signs are that they are compact, easy to use, and highly visible; can be set up quickly; and allow the advertisement, message, or information to be changed as needed (i.e., they allow for flexibility in the advertisement, message, or information being communicated). The portability of such signs permits them to be moved and located strategically and optimally so that the advertisement, message, or information which the sign communicates is easily seen and read by the intended audience.

The simplest signs are made of poster board. Poster board is a type of flexible display board made out of cardboard that is often used to make posters or signs. One side of standard poster board is typically glossy, while the other side has a matte finish. Poster board usually comes in four-ply, which is thick enough for wet and dry media. Thinner than poster board, oaktag is a smooth-surfaced, flexible, thick paper or lightweight cardboard used especially for making posters and signs. These materials have several drawbacks, including the risks of tearing or ripping, susceptibility to the adverse impact of weather conditions, a relative lack of rigidity or sturdiness, limited reusability, creation of paper or cardboard waste, and difficulty and perhaps even pain in grasping and holding by the user.

Blackboards are known in the art. Usually these are fairly large, flat boards that are hung on walls. A problem with such boards is that they are generally fixed and not portable. The need for a portable writing board arises when a user wants a writing surface in a place or location where there is none.

Chalkboards now available have wooden or metal frames and are difficult to transport. A chalkboard must be carried by holding the frame directly which causes structural stress on the frame assembly, resulting eventually in a break-down of the frame. A chalkboard designed for transportation to a variety of locations also has a limited writing surface area.

Display boards such as dry-erase boards or "whiteboards" are commonly used for the presentation of graphics and written material during presentations. The majority of dry-erase boards consist of a writing surface and a surrounding frame, and are designed to be permanently hung or mounted to a wall. Permanently mounted boards are satisfactory for use in rooms where a constant need exists for the board, such as in classrooms. Many presentations take place, however, where a permanently installed board may not be available or desired (such as for aesthetic considerations). In such situations, at least the temporary availability of a board is desired.

There are examples of dry-erase boards that are portable. The portable dry-erase boards have easel stand-like legs incorporated into their design. Unfortunately, the portable boards tend to be bulky, complicated to set up, relatively unsteady during use, and provide limited display or writing space. Further, the portable boards are not very versatile, in that they can only be easily used with the incorporated legs and are therefore not readily adaptable to use with different support structures that may be available, such as easel stands (that may be sturdier than the incorporated legs), tabletops (that may be more appropriate in some applications), or available wall mounts. For example, many rooms that are used periodically for presentations or meetings, although not having permanently mounted boards, do have easel stands readily available. Commonly available are easel stands of the type designed to hold large pads of paper ("easel pads"), where individual sheets may be torn off to reveal a new sheet, or alternately flipped over the top of the pad as a "flip chart."

Easel stands maintain the easel pads on the easel stand in a variety of manners. For example, a tray may protrude from the easel stand to support the easel pad from the bottom, such that the top of the pad simply reclines against the easel stand. Some easel stands have posts extending from an upper portion of the easel stand that are designed to engage pre-punched holes in a top portion of the easel pad. After the pad is positioned on the posts, a retaining member typically engages the ends of the posts to secure the pad. Other easel stands have a clamping member for accepting the top edge of an easel pad. The clamping members include spring-type clamps, manual clamps, and gravity-aided cam mechanisms, for example. Usually, clamping members have a capacity limited to dimensions of a typical easel pad thickness.

Numerous teaching and coaching situations require the use of chalkboards and other visual aids for instructional purposes. Certain instructional situations occur outside the ordinary classroom, however, with its fixed chalkboards and/or require frequent changes of location. On such occasions, a practical, lightweight, portable visual aid would be a valuable instructional tool. At the present time, there are no practical, lightweight, portable visual aids available which can be easily transported to different locations and which are adaptable for use with large or small groups of students or athletes.

Despite the plethora of portable signs available, there is no single portable sign assembly that provides the multiple advantages required by a modern presenter. Therefore, a need exists for a portable sign assembly useful to facilitate communication, which offers improved performance and versatility and which remedies the limitations of portable signs and visual aids presently in use. An object of the present disclosure is to provide an improved, practical, lightweight, sturdy, portable sign assembly having multiple advantages such as visual appeal sufficient to grab the attention of an audience. A related object is to move the sign assembly easily via user-friendly handholds. Another object is to fold the portable sign assembly to facilitate storage and transport. An additional object is to provide a sign that is made of environmentally friendly materials and that can withstand inclement weather conditions such as rain, sleet, or snow. Still another object is to include both a magnetic portion enabling the attachment of magnets and a telescoping extension pole that allows the user to adjust the height of the sign, maneuver the sign, prop up the sign, and facilitate viewing by the audience. It is yet another object of the present disclosure to allow the height of the sign to be adjusted, up and down, to be compatible with the Americans with Disabilities Act of 1990 or ADA, to accommodate presenters of different heights, and to allow presenters to sit or stand.

SUMMARY OF THE DISCLOSURE

To meet this and other needs and to achieve these and other objects, and in view of its purposes, the present disclosure reveals a portable folding sign assembly that provides the multiple advantages required by a presenter to an audience. The assembly is especially useful during protests but may be used elsewhere, such as in the travel tour industry (e.g., airport pickup and tours), for street marketing (e.g., in front of stores), and at sporting events, fundraisers, and businesses. The assembly is lightweight and has white boards on both sides that are magnetic so that the user can write on the boards as well as attach magnets to them. Whiteboards allow a user to make a sign in advance but also allow edits. Because the assembly is double-sided, there are front and back options for messaging.

Inclement weather conditions, such as rain or snow, can damage traditional signs, thus making them difficult to read. The assembly of the present disclosure includes Plexiglas® transparent acrylic covers that protect the whiteboards from weather and precipitation, thereby allowing use of a dry erase marker and preventing that marker from running. The assembly also accommodates paper and cardboard, such as an oaktag paper sign, which can slide between the whiteboard and the cover.

The portable folding sign assembly has openings to allow a user to grip it in various positions, e.g., high/mid/low, as well as vertical and horizontal. This configuration gives the user height and grip for windy days. This feature offers an improvement over thin, oaktag materials used in traditional protest signs, which can be painful to hold. The assembly includes a detachable pole. Pole-securing screws may be connected with a link chain to avoid losing them. The pole may be used to hold the sign in the air. A user wishing to take a photograph can use one hand to hold the assembly, while the other hand operates a camera or phone. The pole may prop up the sign allowing the sign to stand raised from the ground, while supporting some of the weight of the assembly. A user may rotate the pole to the back to place the sign on the floor with the pole holding it in position.

The portable folding sign assembly includes hooks or tie-down rings to attach straps for support for transport. The assembly folds in half for transport. The assembly locks open so it is not wobbly and is more secure when operating under windy conditions. In one aspect, the assembly is sized to accommodate an oaktag sign.

The portable folding sign assembly is made of sustainable (conserving an ecological balance by avoiding depletion of natural resources) and eco-friendly materials. Using whiteboards reduces paper waste. The assembly protects paper and cardboard signs so that they can be reused. The assembly allows existing accessories to attach to it, such as night lights for night protests, clamps (e.g., umbrella clamps), writing instruments, erasers, and the like.

In a more specific embodiment, the reusable, portable, folding sign assembly has four main components: a sign board, a connecting mechanism, a telescoping extension pole, and a transparent cover sleeve. The sign board includes first and second sign board portions configured to form an open position in which the sign board portions are aligned linearly and a closed position in which the sign board portions are folded against each other, and at least one handhold to facilitate manipulation by a user. The connecting mechanism holds the first sign board portion and the second sign board portion together. The telescoping extension pole is removably and pivotably attached to the sign board, operable to support the weight of the assembly, and configured to assume an infinite number of extended lengths as desired and set by the user. The transparent cover sleeve is removably attached on one or both of the first sign board portion and the second sign board portion.

It is to be understood that both the foregoing general description and the following detailed description are exemplary, but are not restrictive, of the disclosure.

BRIEF DESCRIPTION OF THE DRAWING

The disclosure is best understood from the following detailed description when read in connection with the accompanying drawing. Included in the drawing are the following figures.

DETAILED DESCRIPTION OF THE DISCLOSURE

Figure 1:
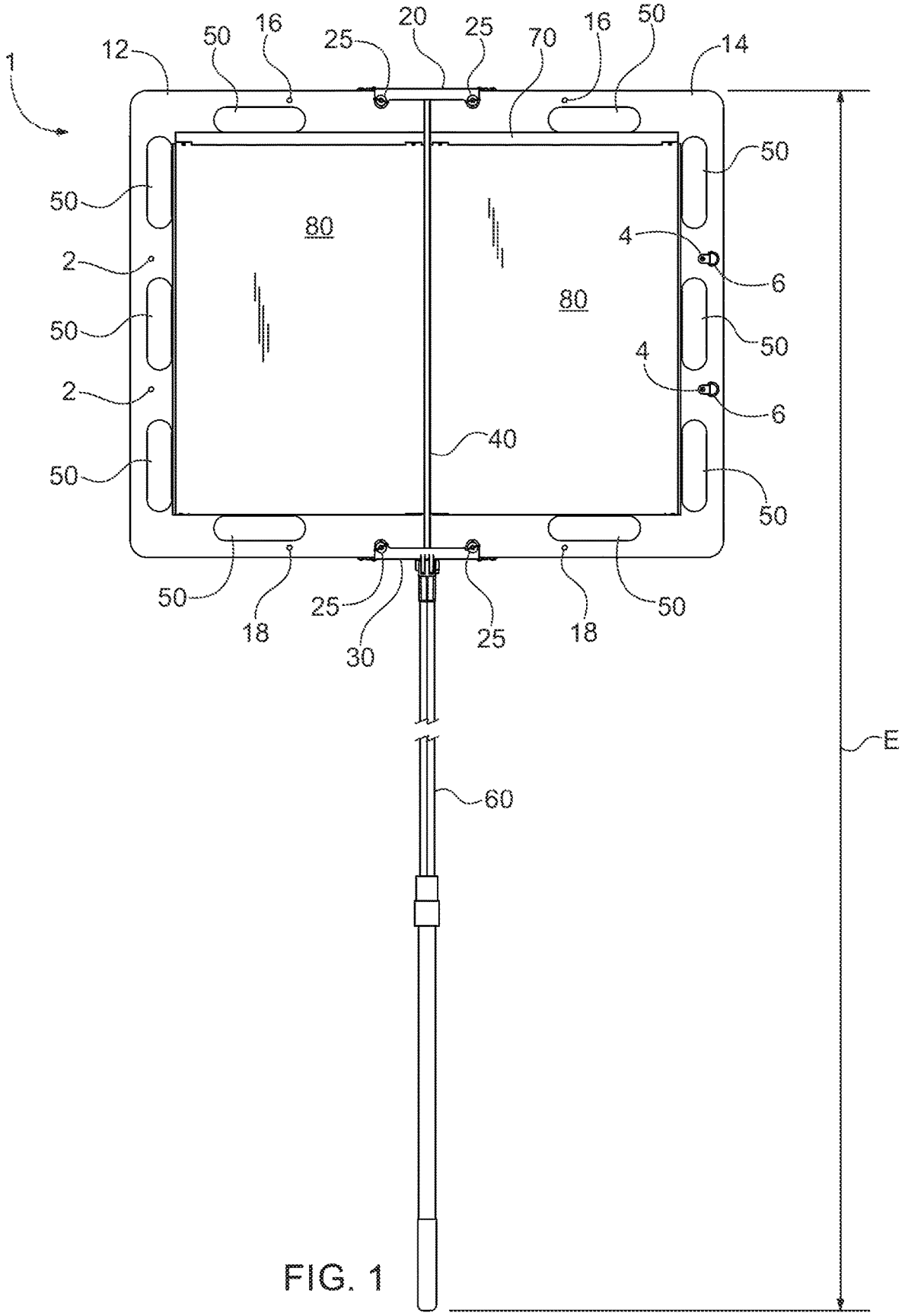
FIG. 1 is a front view of one embodiment of the portable folding sign assembly in accordance with the disclosure, showing the assembly in an open position with the extension pole fully extended.

The features and benefits of the disclosed structures, components, and devices are illustrated and described by reference to exemplary embodiments. The disclosure also includes the drawing, in which like reference numbers refer to like elements throughout the various figures that comprise the drawing. This description of exemplary embodiments is intended to be read in connection with the accompanying drawing, which is to be considered part of the entire written description. Accordingly, the disclosure expressly should not be limited to such exemplary embodiments illustrating some possible non-limiting combinations of features that may exist alone or in other combinations of features.

In this specification and in the claims that follow, reference will be made to a number of terms which shall be defined to have the following meanings ascribed to them. The term "substantially," as used in this document, is a descriptive term that denotes approximation and means "considerable in extent" or "largely but not wholly that which is specified" and is intended to avoid a strict numerical boundary to the specified parameter. "Include," "includes," "including," "have," "has," "having," "comprise," "comprises," "comprising," or like terms mean encompassing but not limited to, that is, inclusive and not exclusive. The indefinite article "a" or "an" and its corresponding definite article "the" as used in this disclosure means at least one, or one or more, unless specified otherwise.

The term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When a value is described to be about or about equal to a certain number, the value is within ±10% of the number. For example, a value that is about 10 refers to a value between 9 and 11, inclusive. When the term "about" is used in describing a value or an end-point of a range, the disclosure should be understood to include the specific value or end-point. Whether or not a numerical value or end-point of a range in the specification recites "about," the numerical value or end-point of a range is intended to include two embodiments: one modified by "about" and one not modified by "about." It will be further understood that the end-points of each of the ranges are significant both in relation to the other end-point and independently of the other end-point.

The term "about" further references all terms in the range unless otherwise stated. For example, about 1, 2, or 3 is equivalent to about 1, about 2, or about 3, and further comprises from about 1-3, from about 1-2, and from about 2-3. Specific and preferred values disclosed for components, materials, and like aspects, and ranges thereof, are for illustration only; they do not exclude other defined values or other values within defined ranges. The structures and methods of the disclosure include those having any value or any combination of the values, specific values, more specific values, and preferred values described.

In the description of embodiments, any reference to direction or orientation is merely intended for convenience of description and is not intended in any way to limit the scope of the present invention. Relative terms such as "right," "left," "lower," "upper," "horizontal," "vertical," "above," "below," "up," "down," "top," and "bottom" as well as derivatives of those terms (e.g., "horizontally," "downwardly," "upwardly," etc.) should be construed to refer to the orientation as then described or as shown in the figure under discussion. These relative terms are for convenience of description only and do not require that the apparatus be construed or operated in a particular orientation. Terms such as "attached," "affixed," "connected," "coupled," "interconnected," and similar terms refer to a relationship in which structures are secured or attached to one another either directly or indirectly through intervening structures, as well as both moveable or rigid attachments or relationships, unless expressly described otherwise.

Figure 2:
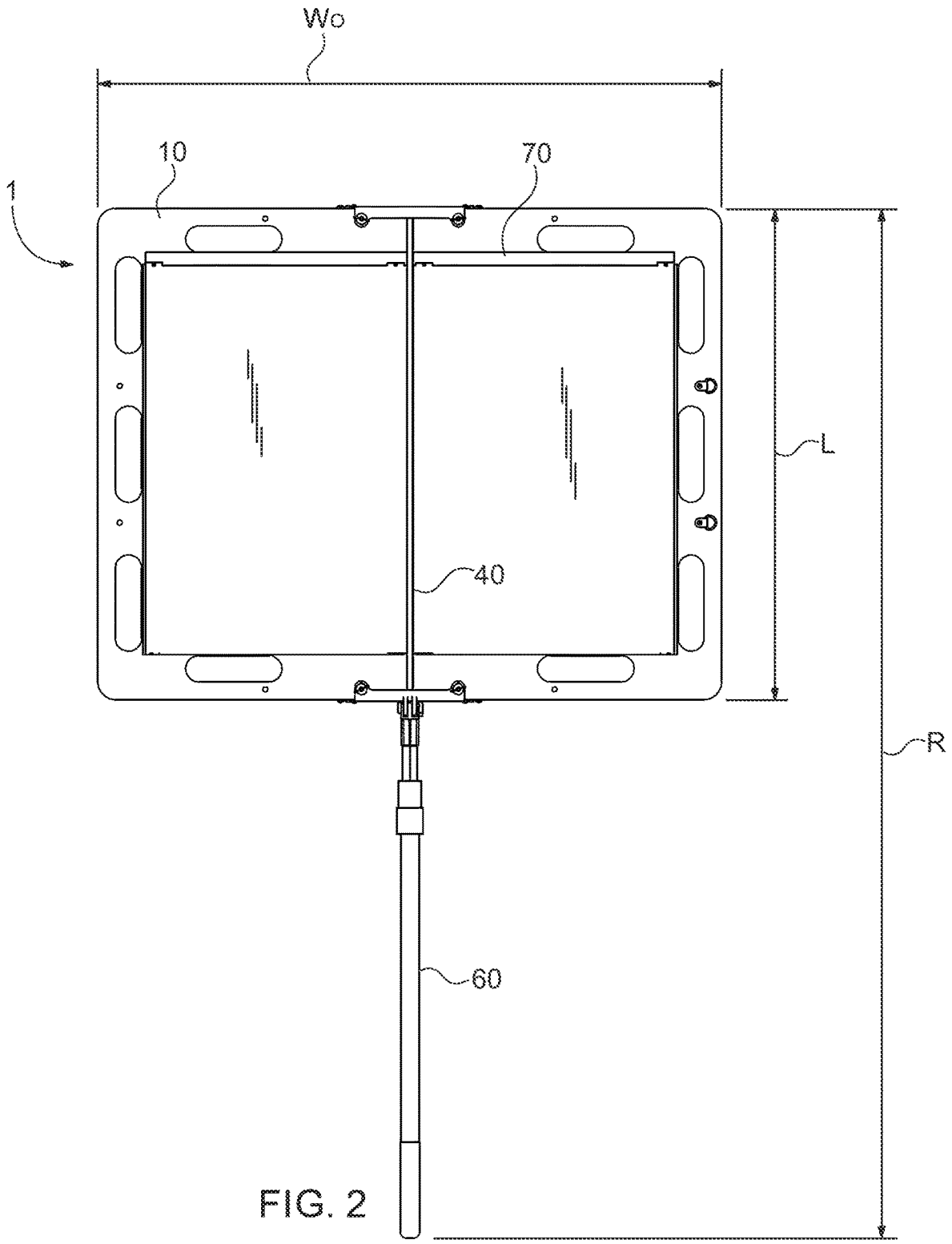
FIG. 2 is a front view of the embodiment of the portable folding sign assembly shown in FIG. 1, showing the assembly in an open position with the extension pole fully retracted.
Figure 3A:
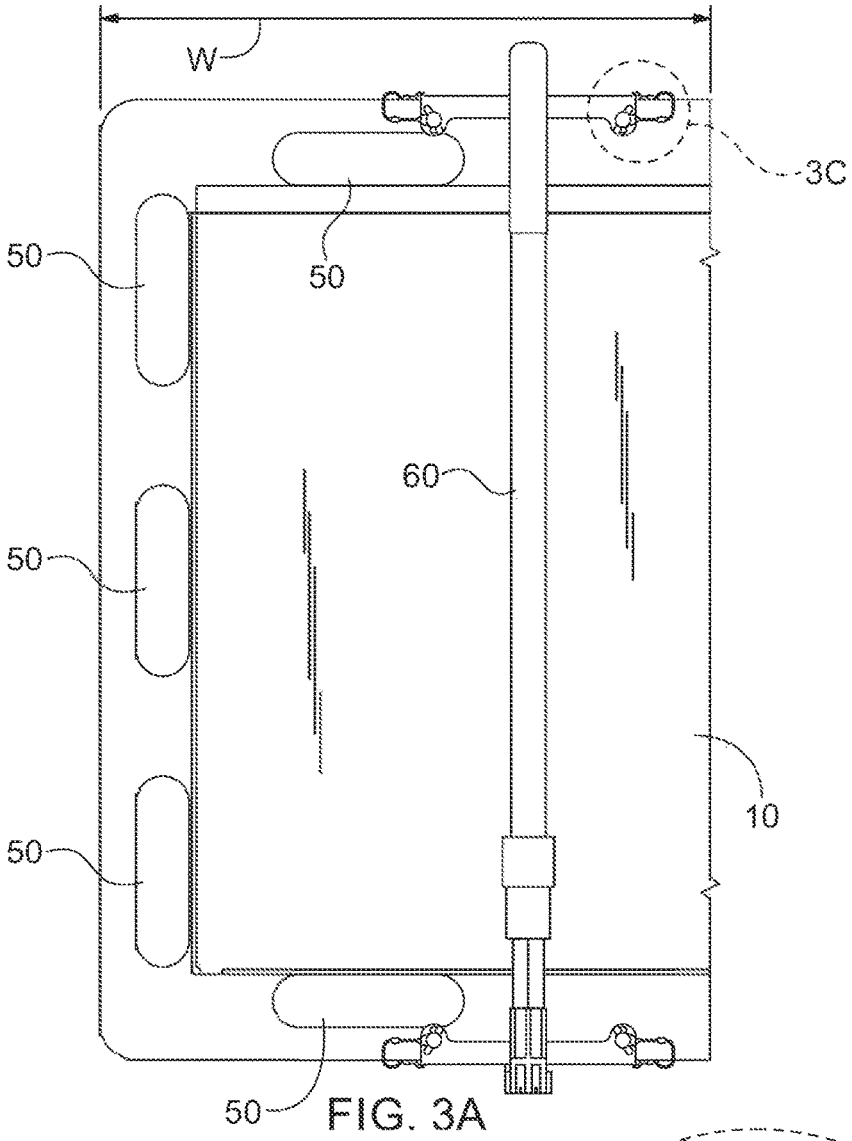
FIG. 3A is a rear view of the embodiment of the portable folding sign assembly shown in FIGS. 1 and 2, with the assembly in a closed position.

Turning now to the figures, FIGS. 1 and 2 illustrate one embodiment of a reusable, portable, folding sign assembly 1 incorporating the improvements of the present disclosure. FIG. 1 shows the assembly 1 in a fully extended position; FIG. 2 shows the assembly 1 in a fully retracted position. The assembly 1 includes a sign board 10 that is formed in two symmetrical halves: a left sign board 12 and a right sign board 14. The left sign board 12 and the right sign board 14 can be arranged by the user to form an open position for use, as shown in FIGS. 1 and 2, or a closed position for storage or transport, as shown in FIGS. 3A (rear view) and 3B (side view).

The sign board 10 can be made of any one of a number of materials_that are lightweight, strong, sturdy, and inexpensive. For example, the sign board 10 may be formed from a plastic, a metal such as aluminum, or a composite material, or may be formed from other common materials of construction, such as corrugated paper or foam core. The sign board 10 may be formed with a solid, corrugated, porous, or hollow structure, such as an I-beam structure, a honeycomb structure, a cellular structure, or any one of a number of other structural forms to provide a lightweight, strong, and inexpensive structure. Preferred materials include plastics, such as acrylonitrile butadiene styrene (ABS) and polypropylene (PP). Thus, the sign board 10 can be made from a bubble honeycomb PP sheet having a thickness of about 0.16 inches (4 mm) or from a hollow ABS body having a wall thickness of about 0.0625 inches (1.6 mm).

The left sign board 12 and the right sign board 14 each have top apertures 16 (although more top apertures 16 are possible, two are shown) disposed along their top edge and bottom apertures 18 (although more bottom apertures 18 are possible, two are shown) disposed along their bottom edge. The top apertures 16 and the bottom apertures 18 accept a connecting mechanism that connects and holds the left sign board 12 and the right sign board 14 together. In the first embodiment, the connecting mechanism includes a top brace 20 and a bottom brace 30. The top brace 20 is configured to engage and disengage from the top apertures 16 and the bottom brace 30 is configured to engage and disengage from the bottom apertures 18. Preferred materials for the top brace 20 and the bottom brace 30 include plastics, such as ABS.

With the connecting mechanism attached to the center-most top aperture 16 and the center-most bottom aperture 18 on each of the left sign board 12 and the right sign board 14, as shown in FIGS. 1 and 2, the left sign board 12 and the right sign board 14 are connected and aligned linearly. The sign board 10 is then in its open position and ready for use. The outer-most top aperture 16 and the outer-most bottom aperture 18 on each of the left sign board 12 and the right sign board 14 are open in this position (i.e., the connecting mechanism does not engage either the outer-most top aperture 16 or the outer-most bottom aperture 18 of the left sign board 12 or the right sign board 14).

Figure 3B:
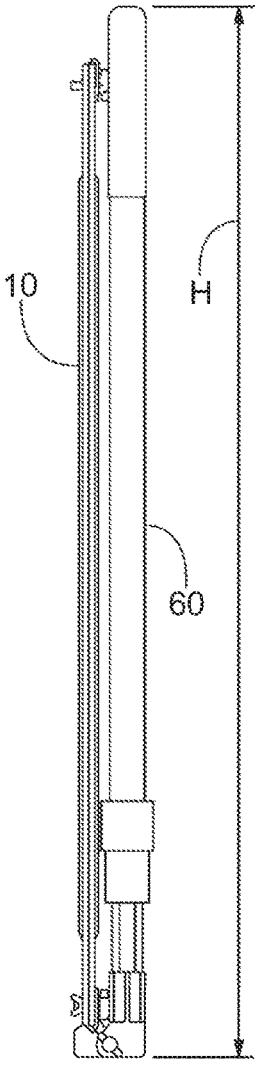
FIG. 3B is a side view of the portable folding sign assembly shown in FIG. 3A.

The user can disengage the connecting mechanism from the sign board 10 and place the left sign board 12 over the right sign board 14 so that the left sign board 12 and the right sign board 14 face each other as shown in FIGS. 3A and 3B. In this position, the center-most top aperture 16 of the left sign board 12 is aligned with the center-most top aperture 16 of the right sign board 14, the outer-most top aperture 16 of the left sign board 12 is aligned with the outer-most top aperture 16 of the right sign board 14, the center-most bottom aperture 18 of the left sign board 12 is aligned with the center-most bottom aperture 18 of the right sign board 14, and the outer-most bottom aperture 18 of the left sign board 12 is aligned with the outer-most bottom aperture 18 of the right sign board 14. The connecting mechanism is then re-attached to the sign board 10. Re-attachment is accomplished by connecting the top brace 20 to both (a) the aligned center-most top apertures 16 on each of the left sign board 12 and the right sign board 14 and (b) the aligned outer-most top apertures 16 on each of the left sign board 12 and the right sign board 14. Similarly, the bottom brace 30 is connected to both (a) the aligned center-most bottom apertures 18 on each of the left sign board 12 and the right sign board 14 and (b) the aligned outer-most bottom apertures 18 on each of the left sign board 12 and the right sign board 14. The sign board 10 is then in its closed position and ready for storage or transport (or for use as a smaller size).

The sign board 10 may be fabricated in common sizes and shapes, including any size or shape as may be required by users of the assembly 1. For purposes of example only, the left sign board 12 and the right sign board 14 can each have a rectangular shape with a width W of about 17.7 inches (450 mm) and a length L of about 28 inches (711 mm). When the left sign board 12 and the right sign board 14 are connected and the assembly 1 is in its open position, as shown in FIGS. 1 and 2, the width Wo (open width) of the assembly 1 is about 35.6 inches (904 mm) with a center gap 40 between the left sign board 12 and the right sign board 14 of about 0.2 inches (5 mm).

The left sign board 12 and the right sign board 14 may comprise any number of configurations, such as having corners that are squared or rounded. As shown in FIGS. 1, 2, and 3A, left sign board 12 and the right sign board 14 may each include rounded corners on their outer edge and squared corners on their inner edge. Rounded corners may facilitate safety when using the assembly 1. Also to facilitate safety, and to enable a user to grasp and easily manipulate the assembly 1, the sign board 10 is provided with a plurality of slots or handholds 50.

Also to enable a user to grasp and easily manipulate the assembly 1, the assembly 1 is provided with an extension pole 60. The extension pole 60 is pivotably attached to the sign board 10 via a mechanism that will be described in detail below. The extension pole 60 may have any suitable collapsed length, but a typical collapsed length will be in the range of about 24 to 48 inches (610 to 1,220 mm). As shown in FIG. 3B, and in one example, the collapsed length of the extension pole 60 and the length of its attachment mechanism combine to give the assembly 1 a height H of about 30.4 inches (772 mm).

The extension pole 60 is telescoping so that it can assume an infinite number of extended lengths as desired and set by the user. FIG. 1 shows the extension pole 60 in its fully extended position, which gives the assembly 1 an extended height E (in this example) of about 78.7 inches (200 cm). FIG. 2 shows the extension pole 60 in its retracted position, which gives the assembly 1 a retracted height R (in this example) of about 58.7 inches (150 cm).

The sign board 10 may itself have magnetic properties so that magnets can be attached to the sign board 10. The sign board 10 may itself also have properties conducive both for writing on the sign board 10 (including on the front surface and on the rear surface) and for that writing to be easily removed. Alternatively, as more fully described below, a film or other surface treatment or coating may be applied to one or more surfaces of the sign board 10 for these purposes. In the example illustrated, a cover sleeve 70 is affixed to each of the front and rear surfaces of both the left sign board 12 and the right sign board 14. Thus, a total of four cover sleeves 70 are provided as part of the assembly 1. Each of the cover sleeves 70 may be formed from a suitable material, such as clear (transparent) polypropylene having a thickness of about 0.003 inches (0.076 mm).

If the sign board 10 does not alone have dry erase properties, the assembly 1 may be configured to include the cover sleeve 70 on one or both of the front surface and the rear surface, or on predetermined portions of those surfaces, of the sign board 10. (By "predetermined" is meant determined beforehand, so that the predetermined characteristic must be determined, i.e., chosen or at least known, in advance of some event such as manufacture of the assembly 1.) The cover sleeve 70 may comprise any biaxially-oriented polyester film, UV-cured polyurethane, polypropylene, or any other product, surface treatment, or coating that may provide the sign board 10 with dry erase properties. A preferred material for the cover sleeve 70 is ultra-clear glass or Plexiglas® transparent acrylic in sheet form (available from Arkema of France). The cover sleeve 70 or such other products, surface treatment, or coating may have magnetic properties or non-magnetic properties. The cover sleeve 70 may act as a carrier for the application of dry erase treatments or coatings if the cover sleeve 70 itself does not have dry erase properties. Depending on the chosen material of the cover sleeve 70 or the subsequent treatment or coating that may be applied to the cover sleeve 70, if any, the thickness of the cover sleeve 70 may range from approximately 0.005 inches (0.127 mm) to approximately 0.050 inches (1.27 mm). The cover sleeve 70 may be laminated, deposited, or adhered to the sign board 10 using conventional techniques known to one of skill in the art. One particularly advantageous way to attach the cover sleeve 70 to the sign board 10 is described in more detail below.

As shown in FIGS. 1 and 2, the sign board 10 may have a plurality of side holes 2. Two of the side holes 2 can accept stainless steel rivets 4, for example, used to attach stainless steel tie down rings 6 to the side edge of the sign board 10. Such tie down rings 6 can be used to hold the left sign board 12 and the right sign board 14 together when the assembly 1 is in its closed position for storage or transport, as shown in FIGS. 3A and 3B. The side holes 2 can perform many other functions for the assembly 1. For example, the side holes 2 can be used to attach accessories to the assembly 1 or to attach straps useful when transporting the assembly 1.

It is known in the art to supply accessories with whiteboards and a variety of accessories can be including in the assembly 1. Such accessories may include, for example, writing instruments such as pens, pencils, and dry-erase markers; an eraser; a tray to hold the writing instruments and the eraser; night lights; clamps; and other conventional items. A whiteboard with no writing instrument may be almost useless. Dry-erase markers offer high quality writing performance and, as their name implies, can be dry-erased using an eraser or cloth. A damp, lint-free, microfiber or cotton cloth (which constitutes an additional accessory) can be used to erase or clean the sign board 10 and render the sign board 10 ready to accept new writing. Dry erase cleaner or isopropyl alcohol can facilitate the process of erasing. The accessories may be fastened to or releasably retained on the assembly 1 using conventional mechanisms, such as fasteners, interference fits, snap fits, or adhesives, perhaps through the side holes 2. The assembly 1 may also include a mount to permit securing or mounting of the assembly 1 onto any surface, such as a vertical surface. The mount may comprise, for example, one or more conventional picture hanger mounts or one or more hook and loop strips as may be necessary, depending on the overall size and weight of the assembly 1.

Figure 4:
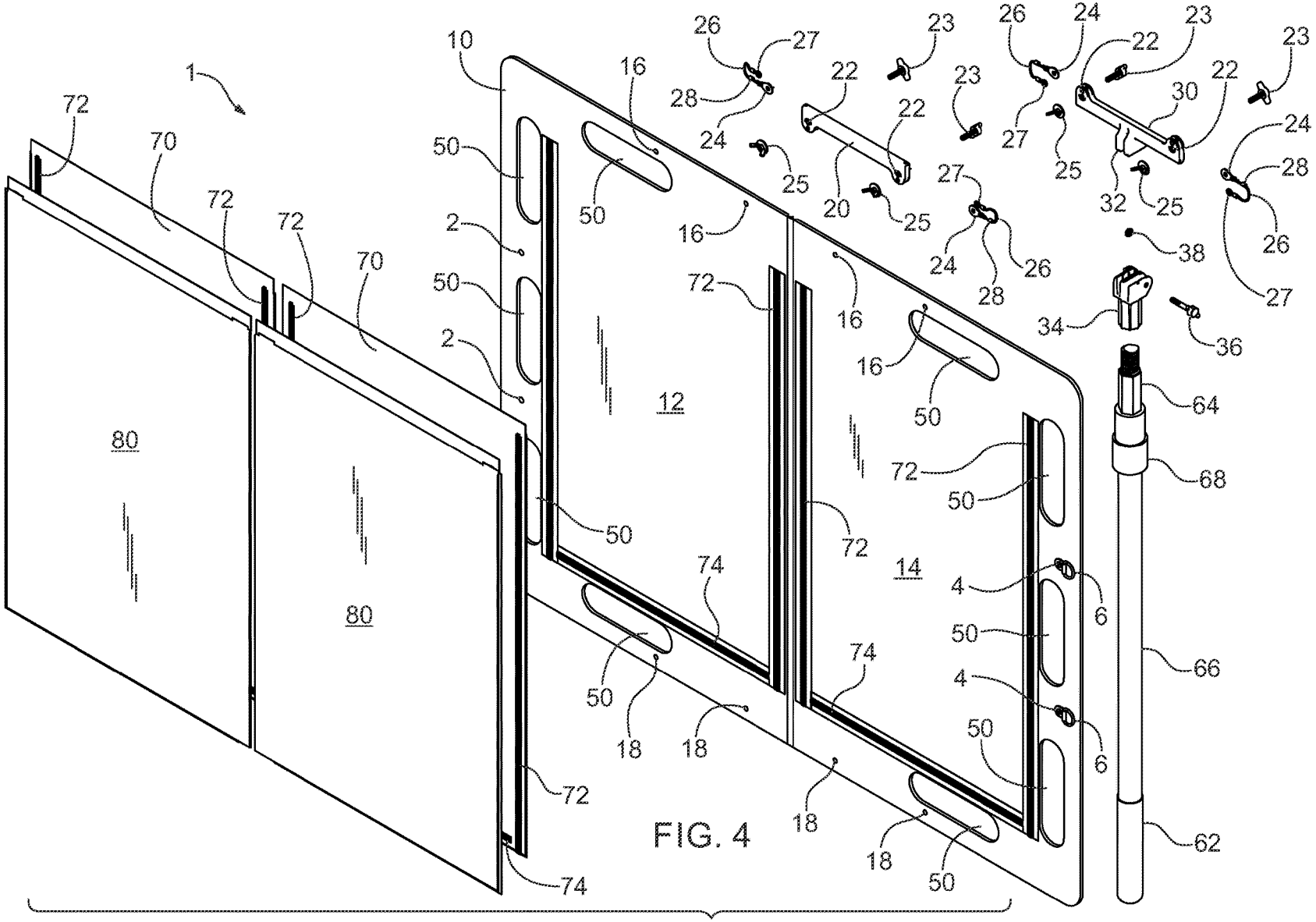
FIG. 4 is an exploded perspective view of the embodiment of the portable folding sign assembly shown in FIGS. 1, 2, 3A, 3B, and 3C.

FIG. 4 is an exploded perspective view of an embodiment of the portable folding sign assembly 1, illustrating one particularly advantageous way to attach the cover sleeve 70 to the sign board 10. Four cover sleeves 70 are provided in this embodiment, one each for the front surface of the left sign board 12, the rear surface of the left sign board 12, the front surface of the right sign board 14, and the rear surface of the right sign board 14. The left sign board 12 has a pair of vertical press lock zippers 72 on its front surface and, optionally, on its back surface. The right sign board 14 also has a pair of vertical press lock zippers 72 on its front surface and, optionally, on its back surface. The vertical press lock zippers 72 are preferably made of polyethylene and have a width of about 0.94 inches (24 mm) and a length of about 22.2 inches (57 cm). The left sign board 12 and the right sign board 14 each have a horizontal press lock zipper 74 on their front surface and, optionally, on their back surface. The horizontal press lock zippers 74 connect with the vertical press lock zippers 72 to form a U-shaped pattern on the surfaces of the left sign board 12 and the right sign board 14. The horizontal press lock zippers 74 are preferably made of polyethylene and have a width of about 0.94 inches (24 mm) and a length of about 13 inches (33 cm).

A corresponding U-shaped pattern of vertical press lock zippers 72 and horizontal press lock zippers 74 is provided on the back surface and, optionally, on the front surface of each of the cover sleeves 70. The cover sleeves 70 can then be attached to the sign board 10 by pressing the corresponding press lock zippers together. The cover sleeves 70 can also be detached from the sign board 10 by pulling the corresponding press lock zippers apart. The U-shaped patterns of vertical press lock zippers 72 and horizontal press lock zippers 74 on the cover sleeves 70 and on the sign board 10 create one or more pockets between the cover sleeves 70 and on the sign board 10, with each pocket having an open top devoid of a press lock zipper. Thus, the assembly 1 accommodates paper and cardboard, such as an oaktag paper sign, which can slide between the cover sleeves 70 and on the sign board 10.

As shown in FIG. 4, the assembly 1 can also include one or more clear folders 80. A corresponding U-shaped pattern of vertical press lock zippers 72 and horizontal press lock zippers 74 is provided on the back surface of each of the folders 80, facilitating attachment of the folders 80 to the cover sleeves 70 or to the sign board 10. Thus, the folders 80 can protect one or both of the cover sleeves 70 and the sign board 10, for example from adverse weather conditions when the assembly 1 is used outside. The folders 80 can also create one or more pockets between the cover sleeves 70 or the sign board 10, with each pocket having an open top devoid of a press lock zipper. Such pockets allow the assembly 1 to accommodate paper and cardboard, such as an oaktag paper sign, which can slide between the folders 80 the cover sleeves 70 or the sign board 10.

Rather than the vertical press lock zippers 72 and the horizontal press lock zippers 74, the connections among the left sign board 12, the right sign board 14, the cover sleeves 70, and the folders 80 could be made using a Velcro® material. Velcro® is the brand name of the first commercially marketed fabric hook-and-loop fastener sold by Velcro USA, Inc. of Manchester, N.H. The fastener was invented by George de Mestral. See U.S. Pat. No. 3,009,235. Hook-and-loop fasteners consist of two components: typically, two lineal fabric strips or tapes (alternately round dots or squares) which are attached (e.g., sewn, adhered, etc.) to the opposing surfaces to be fastened. The first component features tiny hooks (e.g., the hook tape); the second features even smaller and "hairier" loops (e.g., the loop tape). When the two surfaces are pressed together, the hooks catch in the loops—and the two pieces fasten or bind temporarily. When separated, by pulling or peeling the two surfaces apart, the Velcro strips make a distinctive "ripping" sound.

Still referring to FIG. 4, the top brace 20 and the bottom brace 30 are illustrated. The top brace 20 is configured to engage and disengage from the top apertures 16 of the sign board 10 and the bottom brace 30 is configured to engage and disengage from the bottom apertures 18 of the sign board 10, although the reverse is possible: the top brace 20 could be configured to engage and disengage from the bottom apertures 18 of the sign board 10 and the bottom brace 30 could be configured to engage and disengage from the top apertures 16 of the sign board 10. The components used to attach the top brace 20 and the bottom brace 30 to, and detach the top brace 20 and the bottom brace 30 from, the sign board 10 will now be described.

Turning first to the top brace 20, the top brace 20 has one or more holes 22. Each hole 22 is configured to receive the stem of a thumb screw 23, which is preferably a plastic head thumb screw. The stem of the thumb screw 23 passes through the hole 22, then through the top aperture 16 of the sign board 10, and then through a washer 24 where the stem of the thumb screw 23 can engage a flanged wing nut 25 to attach the top brace 20 to the sign board 10. Disengagement of the flanged wing nut 25 from the thumb screw 23 allows removal of the thumb screw 23 from the top aperture 16 and, therefore, detachment of the top brace 20 from the sign board 10.

The washer 24 is preferably made of nylon. Nylon is a term coined by its inventors at E.I. duPont de Nemours & Co., Inc. Not a trademark, the term designates any of a family of high-strength, resilient, synthetic materials whose long-chain molecule contains the recurring amide group CONH. The official chemical name for nylon is polyhexamethyleneadipamide, referred to as polyamide.

The washer 24 is attached to a retaining cable or wire tether 26 which, in turn, is attached to an eye tether 27. The eye tether 27 is attached to the thumb screw 23. The wire tether 26 is preferably coated galvanized wire having a diameter of about 0.0625 inches (1.6 mm) and a length of about 4 inches (10.2 cm). One or more compression sleeves 28 is or are crimped onto the wire tether 26 to create a loop in the wire tether 26. The compression sleeves 28 can be made of aluminum.

Figure 3C:
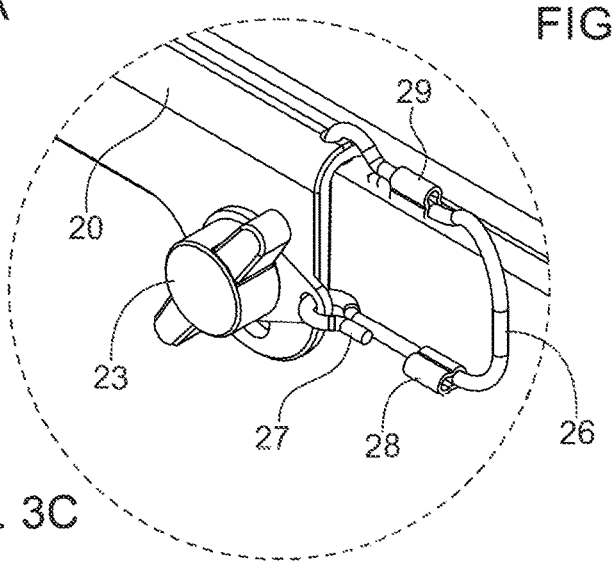
FIG. 3C is a detailed view of the portable folding sign assembly shown in FIGS. 3A and 3B, highlighting components used to attach the top brace to the sign board.

As shown in FIG. 3C, a bracket 29 can be provided on the top of the sign board 10. FIG. 3C is a detailed view of the portable folding sign assembly 1 shown in FIGS. 3A and 3B, highlighting the components used to attach the top brace 20 to the sign board 10. The wire tether 26 can be attached through the eye tether 27 directly to the thumb screw 23 on one end and its opposite end can pass through the bracket 29. The thumb screw 23, the washer 24, the wing nut 25, the wire tether 26, the eye tether 27, the compression sleeve 28, and the bracket 29 help to attach the top brace 20 to the sign board 10.

As shown in FIG. 4, the bottom brace 30 can be attached to and detached from the sign board 10 using components identical to the components used to attach the top brace 20 to and detach the top brace 20 from the sign board 10. In addition, the bottom brace 30 has an integral first hinge 32. By "integral" is meant a single piece or a single unitary part that is complete by itself without additional pieces, i.e., the part is of one monolithic piece formed as a unit without another part.

The first hinge 32 is configured to engage a separate second hinge 34. Preferred materials for the first hinge 32 and the second hinge 34 include plastics, such as ABS. Engagement between the first hinge 32 and the second hinge 34 can be achieved using conventional components. As illustrated in FIG. 4, the first hinge 32 is attached to (i.e., engages) the second hinge 34 using a second thumb screw 36 and a second nut 38. These components allow the first hinge 32 and the second hinge 34 both to rotate with respect to one another and to be locked in a specific position with respect to one another.

The second hinge 34 is configured to engage the extension pole 60 and, more specifically, the head 64 of the extension pole 60. Engagement between the second hinge 34 and the head 64 of the extension pole 60 can be achieved using conventional components. As illustrated in FIG. 4, the second hinge 34 is attached to (i.e., engages) the head 64 of the extension pole 60 using threads on the inside of the second hinge 34 and mating threads on the outside of the head 64 of the extension pole 60.

In addition to the head 64, the extension pole has a handle 62 located on the end of the extension pole 60 opposite the head 64. The handle 62 is ergonomically designed to facilitate manipulation of the extension pole 60 and, therefore, of the assembly 1 by a user. A body 66 is integral with, and located between, the head 64 and the handle 62. Located on the body 66 is an extension lock 68. The extension lock 68 allows a user to extend the extension pole 60 to an infinite number of lengths, between the fully extended position shown in FIG. 1 and the fully retracted position shown in FIG. 2, and to lock the extension pole 60 in a desired position (thereby fixing the length of the extension pole 60). Of course, the user can subsequently release the extension lock 68 to change the length of the extension pole 60.

Thus, the extension pole 60 telescopes so that the height of the sign board 10 with respect to a fixed surface such as the ground or a table can be adjusted by extending and retracting the extension pole 60. The height can accommodate the heights of different users and allow the user to sit or stand. The height can be adjusted to an infinite number of positions within a specified vertical range. The Americans with Disabilities Act of 1990 or ADA is a law that prohibits discrimination based on disability. The ADA requires covered employers to provide reasonable accommodations to employees with disabilities, and imposes accessibility requirements on public accommodations. The adjustability of the assembly 1 helps employers meet the requirements of the ADA.

Figure 5:
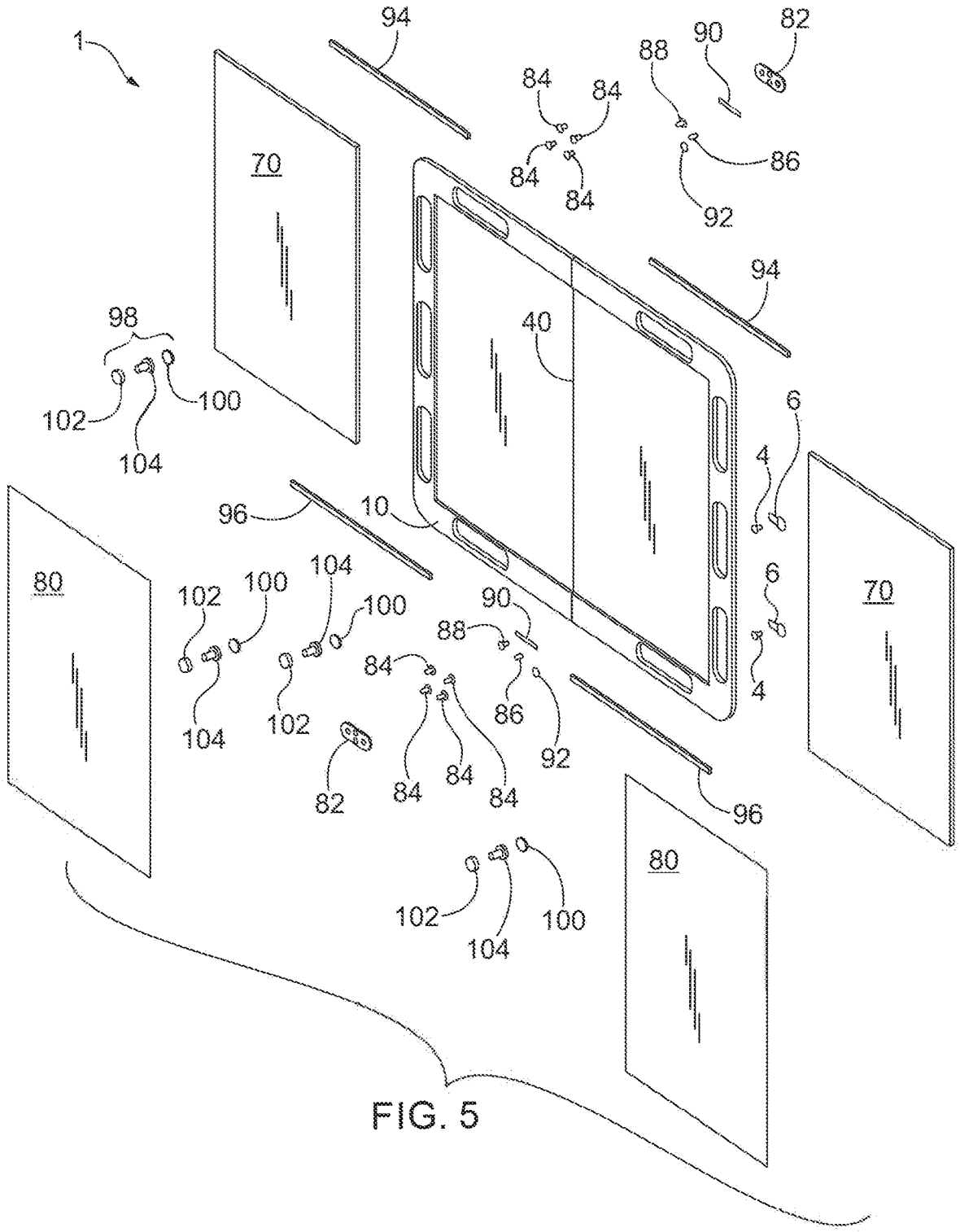
FIG. 5 is an exploded perspective view of an alternative embodiment of the portable folding sign assembly.

FIG. 5 is an exploded perspective view of an alternative embodiment of the portable folding sign assembly 1. Many of the components of the first embodiment of the assembly 1 are common to the alternative embodiment. Among the new components added to the alternative embodiment illustrated in FIG. 5 are one or more flexible joints 82, a latch 90, a top rail (trim) 94 and a bottom rail (trim) 96, and one or more magnetic subassemblies 98.

Referring to FIG. 5, the sign board 10 is shown in its fully opened position. To permit unlimited and repetitive opening and closing of the left sign board 12 and the right sign board 14, the flexible joints 82 connect the left sign board 12 to the right sign board 14. Two flexible joints 82 are illustrated, although one, three, or more flexible joints may be a suitable number depending upon a particular application. The flexible joint 82 may be a surface-mount hinge, as shown, or a living hinge. A living hinge or integral hinge is a thin flexible hinge (flexure bearing) made from the same material as the two rigid pieces it connects. A living hinge is typically thinned or cut to allow the rigid pieces to bend along the line of the hinge. The flexible joint 82 may be attached to both the left sign board 12 and to the right sign board 14 using a plurality of fasteners 84 such as screws, rivets, bolts, and the like so that the flexible joint 82 spans the center gap 40 between the left sign board 12 and to the right sign board 14.

The latch 90 also spans the center gap 40 between the left sign board 12 and to the right sign board 14. The latch 90 is affixed to one of the left sign board 12 and the right sign board 14 using a rivet 88, and may be located proximate the top of the sign board 10. A corresponding latch pin 86 is affixed to the other of the left sign board 12 or the right sign board 14 to which the latch 90 is not attached. Thus, the latch 90 can engage the latch pin 86 to maintain the sign board 10 in its fully opened position, as shown in FIG. 5, and can be disengaged from the latch pin 86 to allow the sign board 10 to be folded into its closed position for transport and storage. A magnet 92 can also be provided proximate each latch 90.

The one or more magnetic subassemblies 98 can also be affixed to the sign board 10. Four subassemblies 98 are illustrated in FIG. 5, although one, two, three, five, or more magnetic subassemblies 98 may be a suitable number depending upon a particular application. Each subassembly 98 includes a magnet 100, a magnet cushion 102, and a flat head screw 104. The flat head screw 104 is used to affix the magnet 100 and the magnet cushion 102 to the sign board 10. Preferably, the magnet 100 is countersunk into the sign board 10 so that the head of the flat head screw 104 is flush with the surface of the sign board 10.

The assembly 1 may include the top rail 94, the bottom rail 96, or both, which may be configured to connect to the sign board 10 along the top and/or bottom edge of the sign board 10. Each of the top rail 94 and the bottom rail 96 may have two halves, one half attached to the left sign board 12 and the other half attached to the right sign board 14—as illustrated in FIG. 5. The top rail 94 and the bottom rail 96 may be made from any durable, low-cost, and lightweight material that may, for example, be injection molded, such as high-impact polystyrene ABS plastic or polycarbonate. The top rail 94 and the bottom rail 96 may provide aesthetic enhancement to the top and/or bottom edge of sign board 10. Either or both of the top rail 94 and the bottom rail 96 may also provide mechanical enhancement for the operation of the sign board 10. For example, the top rail 94 and/or the bottom rail 96 may protect the edges of the sign board 10 from damage, provide structural support for the sign board 10, and/or facilitate attachment of another component such as the flexible joint 82 to the sign board 10.

Figure 6A:
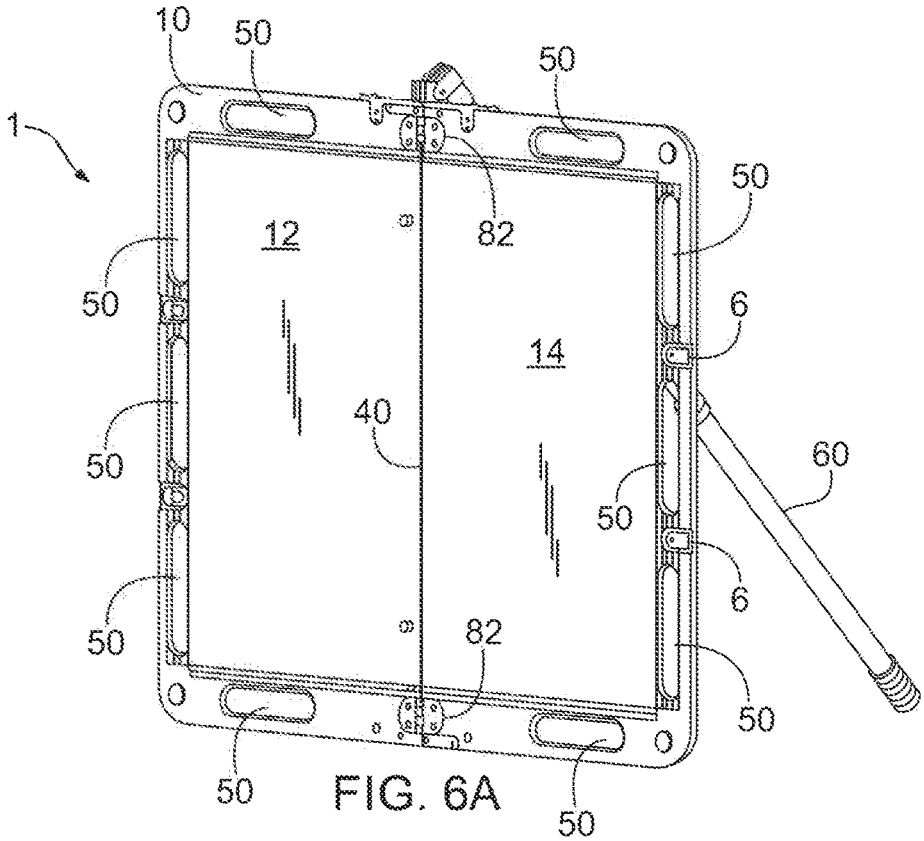
FIG. 6A is a perspective view of the assembly shown in FIG. 5 in a short ground configuration.
Figure 6B:
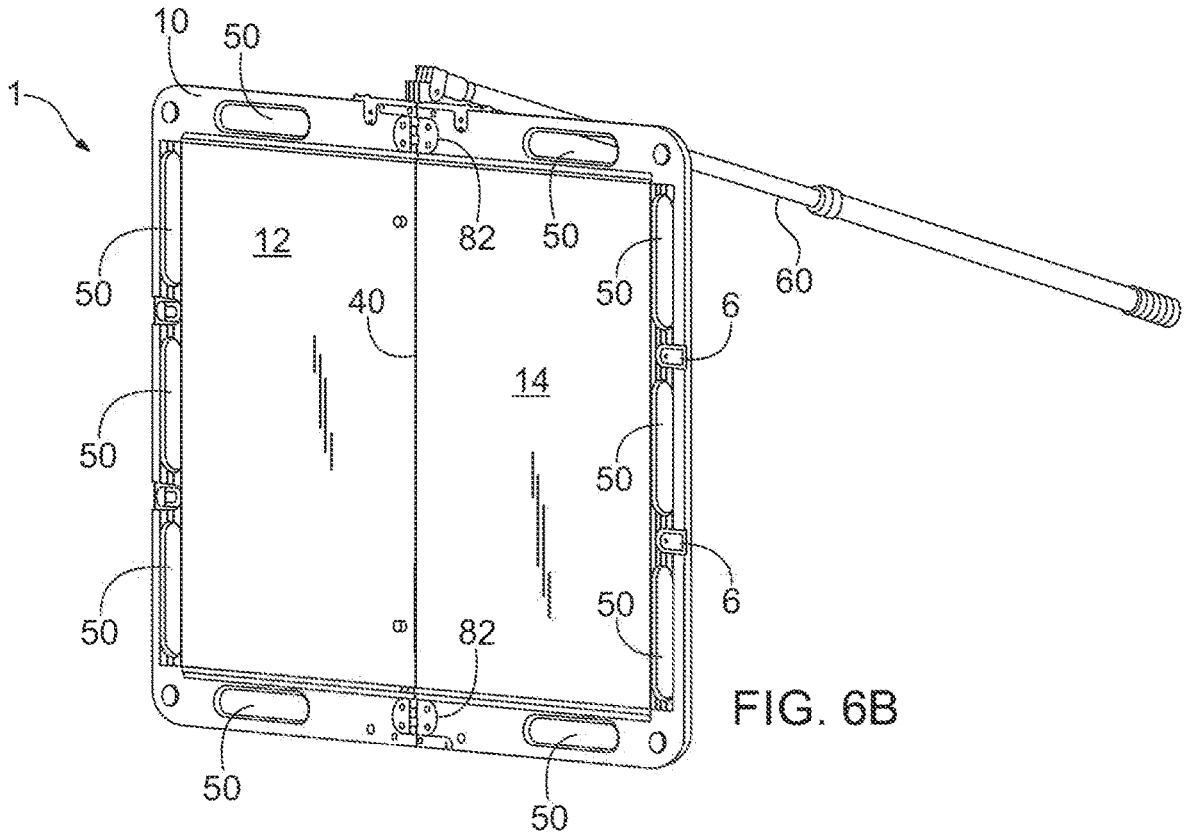
FIG. 6B is a perspective view of the assembly shown in FIG. 5 in a long ground configuration.

Like the first embodiment of the assembly 1, the alternative embodiment of the assembly 1 illustrated in FIG. 5 can be placed into an infinite number of positions and orientations of the sign board 10 using the extension pole 60. Two of those positions and orientations are illustrated in FIGS. 6A and 6B. FIG. 6A is a perspective view of the assembly shown in FIG. 5 in a short ground configuration. FIG. 6B is a perspective view of the assembly shown in FIG. 5 in a long ground configuration.

Rather than forming the sign board 10 in two, separated sections (the left sign board 12 and the right sign board 14), the sign board 10 can be formed as one integral piece of material. In this embodiment of the sign board 10, there is no gap 40. The sign board portions are separated by a central, longitudinal crease formed in the sign board 10 when one of the portions is folded against the other portion. The material used to construct the sign board 10 in this embodiment permits such folding and the formation of the crease.

Although illustrated and described above with reference to certain specific embodiments and examples, the present disclosure is nevertheless not intended to be limited to the details shown. Rather, various modifications may be made in the details within the scope and range of equivalents of the claims and without departing from the spirit of the disclosure.

What is claimed:

1. A reusable, portable, foldable sign assembly having a weight and comprising:

a sign board including a first sign board portion and a second sign board portion configured to form an open position in which the first sign board portion and the second sign board portion are aligned linearly and a closed position in which the first sign board portion and the second sign board portion are folded against each other, and at least one handhold to facilitate manipulation by a user;

a connecting mechanism holding the first sign board portion and the second sign board portion together;

a telescoping extension pole removably and pivotably attached to the sign board, operable to support the weight of the assembly, and configured to assume a number of extended lengths as desired and set by the user; and a transparent cover sleeve removably attached on one or both of the first sign board portion and the second sign board portion.

2. The assembly according to claim 1 wherein the connecting mechanism includes a top brace and a bottom brace.

3. The assembly according to claim 2 wherein the connecting mechanism further includes a screw and a nut releasably attaching the top brace or the bottom brace to the sign board.

4. The assembly according to claim 1 wherein the connecting mechanism includes at least one flexible joint.

5. The assembly according to claim 1 wherein the sign board is magnetic.

6. The assembly according to claim 1 further comprising one or more magnetic subassemblies attached to the sign board.

7. The assembly according to claim 1 wherein the sign board is configured to display removable written information.

8. The assembly according to claim 1 wherein the sign board has an edge including at least one hole through which accessories or straps can be attached to and removed from the assembly.

9. The assembly according to claim 8 further comprising at least one tie down ring attached to the edge.

10. The assembly according to claim 1 further comprising press lock zippers by which the cover sleeve is removably attached on one or both of the first sign board portion and the second sign board portion.

11. The assembly according to claim 10 wherein the press lock zippers form a pattern on both the cover sleeve and the sign board creating a pocket between the cover sleeve and the sign board accommodating insertion of paper, cardboard, and oaktag signs.

12. The assembly according to claim 1 wherein the extension pole has a head, a handle located on an end of the extension pole opposite the head and ergonomically designed to facilitate manipulation of the extension pole by the user, a body integral with and located between the head and the handle, and an extension lock located on the body allowing the user to extend the extension pole to an infinite number of lengths between a fully extended position and a fully retracted position and to lock the extension pole in a desired position thereby fixing the length of the extension pole.

13. The assembly according to claim 1 further comprising a first hinge attached to the sign board and a second hinge attached to the extension pole, the first hinge engaging the second hinge and enabling the extension pole to rotate with respect to the sign board and to be locked in a specific position with respect to the sign board.

14. The assembly according to claim 1 further comprising a top rail and a bottom rail affixed to the sign board, providing aesthetic enhancement, mechanical enhancement, or both aesthetic enhancement and mechanical enhancement to the assembly.

15. The assembly according to claim 1 further comprising a latch that spans a gap between the first sign board portion and the second sign board portion and is attached to one of the first sign board portion or the second sign board portion, and a corresponding latch pin attached to the other of the first sign board portion or the second sign board portion to which the latch is not attached, wherein the latch engages the latch pin to maintain the sign board in its open position and is disengaged from the latch pin to allow the sign board to be folded into its closed position.

16. A reusable, portable, foldable sign assembly having a weight and comprising:

a magnetic sign board configured to display removable written information and including (a) at least one handhold to facilitate manipulation by a user, (b) a first sign board portion and a second sign board portion configured to form an open position in which the first sign board portion and the second sign board portion are aligned linearly and a closed position in which the first sign board portion and the second sign board portion are folded against each other, and (c) an edge having at least one hole through which accessories or straps can be attached to and removed from the assembly;

a connecting mechanism holding the first sign board portion and the second sign board portion together;

a telescoping extension pole removably and pivotably attached to the sign board, operable to support the weight of the assembly, and configured to assume a number of extended lengths as desired and set by the user; and a transparent cover sleeve removably attached by press lock zippers on one or both of the first sign board portion and the second sign board portion, wherein the press lock zippers form a pattern on both the cover sleeve and the sign board creating a pocket between the cover sleeve and the sign board accommodating insertion of paper, cardboard, and oaktag signs.

17. The assembly according to claim 16 wherein the connecting mechanism includes a top brace and a bottom brace.

18. The assembly according to claim 16 wherein the connecting mechanism includes at least one flexible joint.

19. The assembly according to claim 16 further comprising at least one tie down ring attached to the edge.

20. A reusable, portable, foldable sign assembly having a weight and comprising:

a magnetic sign board configured to display removable written information and including (a) at least one handhold to facilitate manipulation by a user, (b) a first sign board portion and a second sign board portion configured to form an open position in which the first sign board portion and the second sign board portion are aligned linearly and a closed position in which the first sign board portion and the second sign board portion are folded against each other, and (c) an edge having at least one hole through which accessories or straps can be attached to and removed from the assembly;

at least one tie down ring attached to the edge;

a connecting mechanism holding the first sign board portion and the second sign board portion together;

a telescoping extension pole having a head removably and pivotably attached to the sign board, a handle located on an end of the extension pole opposite the head and ergonomically designed to facilitate manipulation of the extension pole by the user, a body integral with and located between the head and the handle, and an extension lock located on the body allowing the user to extend the extension pole to a number of lengths between a fully extended position and a fully retracted position and to lock the extension pole in a desired position thereby fixing the length of the extension pole, wherein the extension pole is operable to support the weight of the assembly;

a first hinge attached to the sign board and a second hinge attached to the extension pole, the first hinge engaging the second hinge and enabling the extension pole to rotate with respect to the sign board and to be locked in a specific position with respect to the sign board; and a transparent cover sleeve removably attached by press lock zippers on one or both of the first sign board portion and the second sign board portion, wherein the press lock zippers form a pattern on both the cover sleeve and the sign board creating a pocket between the cover sleeve and the sign board accommodating insertion of paper, cardboard, and oaktag signs.

* * * * *